US007175210B2

(12) United States Patent
Orzech et al.

(10) Patent No.: US 7,175,210 B2
(45) Date of Patent: Feb. 13, 2007

(54) LOCK, ESPECIALLY FOR AUTOMOTIVE DOORS, FLAPS OR THE LIKE

(75) Inventors: Udo Orzech, Wuppertal (DE); Stefan Uecker, Ratingen (DE); Eckart Schuler, Sindelfingen (DE)

(73) Assignees: Huf Hülsbeck & Fürst GmbH, Velbert (DE); DaimlerChrysler AG, Stuttgart (DE)

( * ) Notice: Subject to any disclaimer, the term of this patent is extended or adjusted under 35 U.S.C. 154(b) by 143 days.

(21) Appl. No.: 10/505,202

(22) PCT Filed: Jan. 11, 2003

(86) PCT No.: PCT/EP03/00220

§ 371 (c)(1),
(2), (4) Date: Mar. 7, 2005

(87) PCT Pub. No.: WO03/071065

PCT Pub. Date: Aug. 28, 2003

(65) Prior Publication Data

US 2005/0167990 A1 Aug. 4, 2005

(30) Foreign Application Priority Data

Feb. 19, 2002 (DE) ..... 102 06 813

(51) Int. Cl.
*E05C 3/06* (2006.01)

(52) U.S. Cl. ..... 292/216; 292/201

(58) Field of Classification Search ..... 292/216, 292/201; 70/279
See application file for complete search history.

(56) References Cited

U.S. PATENT DOCUMENTS

| | | | | |
|---|---|---|---|---|
| 4,395,064 A * | 7/1983 | Bellot et al. | ..... | 292/201 |
| 6,048,002 A * | 4/2000 | Ohta et al. | ..... | 292/201 |
| 6,575,507 B2 * | 6/2003 | Reddmann | ..... | 292/216 |

FOREIGN PATENT DOCUMENTS

| | | |
|---|---|---|
| DE | 196 17 428 A1 | 11/1997 |
| DE | 196 50 826 A1 | 6/1998 |
| DE | 199 27 416 A1 | 1/2001 |
| DE | 100 43 574 A1 | 11/2001 |

* cited by examiner

*Primary Examiner*—Gary Estremsky
(74) *Attorney, Agent, or Firm*—Friedrich Kueffner

(57) ABSTRACT

The invention relates to a lock, especially for automotive doors or flaps, comprising a rotary latch (20) with which a closing element (13) engages when the door is closed and which pivots the rotary latch (20) from an open position via a pre-latch position to a main latch position. The lock further comprises a catch (30) which, in a pre-latch position, engages with a pre-stop notch provided on the rotary latch (20), and in a main latch position engages with a main stop notch provided on the rotary latch (20). An actuating element (40) acts upon the catch (30) in the manner of a power-driven opening assistance. An actuating surface (44) which radially enlarges in the direction of rotation (42) effects the lifting of the latch (30) in a simple manner. A loaded lever on the lock prevents the catch (30) from re-engaging with the rotary latch (20) once the catch (30) is disengaged, in case the rotary latch (20) does not pivot to the open position due to a load. The inventive lock is inexpensive to produce and very reliable due to its simple design.

18 Claims, 11 Drawing Sheets

LOCK, ESPECIALLY FOR AUTOMOTIVE DOORS, FLAPS OR THE LIKE

The invention pertains to a lock of the type indicated in the introductory clause of Claim 1 such as that used in, for example, the doors and hatches of motor vehicles. Locks of this type are equipped with rotary latches, which have both a pre-stop notch and a main stop notch, into which a catch can fall. When an open door is closed, a gap sometimes remains if the catch drops only into the pre-stop notch of the rotary latch. The rotary latch will then remain in this prelatching position. To close the gap, motorized closing aids are used, which act on the rotary latch, thus moving the rotary latch into its final position, in which the catch is engaged with the main stop notch. This final position is referred to below as the "main latching position".

A lock of the type indicated above is known from WO 99/49,159. A lock is described here in which a gearbox is mounted on a motorized drive; the gearbox has two power takeoff paths. The first power takeoff path can act as a closing aid on the rotary latch, and the second power takeoff path can act as an opening aid on the catch. A transmission element is provided on the gearbox, which can be used to activate one or the other of these takeoff paths while keeping the other one deactivated, depending on whether the drive is to be used as an opening aid or as a closing aid.

The disadvantage of this lock is that a switching mechanism and an additional drive are required to switch the transmission element from one position to the other, as a result of which the lock becomes quite complicated to manufacture.

A lock with a motorized closing and opening aid is also known from WO 98/27,301. The function of an opening aid operates in the first direction of rotation of the drive. A catch is first actuated by a rotary element mounted on the gearbox axis. After the rotary latch has been released by the catch, the second power takeoff path is actuated by drivers, which establish a connection with the rotary movement of the axis of rotation. The second power takeoff path thus gives additional support to the opening movement of the rotary latch. The function of a closing aid operates in the second direction of rotation of the drive. After the door is shut, a pulling-in movement is transmitted to the rotary latch via the second power takeoff path, while the catch is moved into its latching position in the rotary latch.

The disadvantage of this lock is that complicated connecting and control means are required to accomplish the chronologically offset connection of the two power takeoff paths to the drive so that the connection can be accomplished at precisely the right time. This lock is therefore relatively expensive to manufacture.

The task of the invention is to develop a lock of the previously mentioned type which works reliably but which also avoids the disadvantages cited above. This is accomplished according to the invention by the features cited in Claim 1, to which the following special meaning attaches. The uniqueness of the measures described is to be found in that the power takeoff paths provided on the gearbox remain connected at all times to the drive. As a result of this measure, the lock according to the invention can be produced at low cost and, because of its simple design, it operates very reliably.

The activation and deactivation of the power takeoff paths are accomplished on the basis of the rotational direction of the drive. As a result of this measure, there is no longer any need for a transmission element and a switching mechanism with an additional drive or for a connecting means for activating a power takeoff path.

When the inventive lock is to be opened, the catch must be moved out of the main stop notch on the rotary latch. The catch is lifted by an actuating element, which has an actuating surface with a radial dimension which increases in the rotational direction; this surface lifts the catch out of the main stop notch or pre-stop notch on the rotary latch. As soon as the catch has become disengaged from the rotary latch, the restoring force acting on the rotary latch moves it into the open position.

The inventive features of claim 2 come into their own in cases where a load produces a force which is greater than the restoring force which tries to move the rotary latch into the open position. If, therefore, this load, which could take the form of ice in the lock, causes the rotary latch to remain in the closed position even though the "open" signal has been transmitted to the drive, the catch, after it has pivoted out of the main stop notch on the rotary catch, will be able to drop back into this main stop notch again under the effect of its spring-loading, because the rotary latch has still not moved into the open position. To prevent this, a load lever is provided in the lock, which holds the catch in the outward-pivoted position. As soon as the load acting in opposition to the restoring force of the rotary catch has been eliminated, e.g., the ice has melted, and the rotary latch is free again to move into the open position, a pivoting moment is exerted by the rotary latch on the load lever, as a result of which the load lever is pivoted into a position beyond its rest position on the catch, i.e., a position a certain distance away from the catch. With the load lever in this position, the path along which the catch pivots is free, and the catch thus can now pivot back under the action of its spring-loading.

Additional measures and advantages of the invention can be derived from the subclaims, from the following description, and from the drawings. The drawings illustrate the invention on the basis of an exemplary embodiment:

Figure 1:
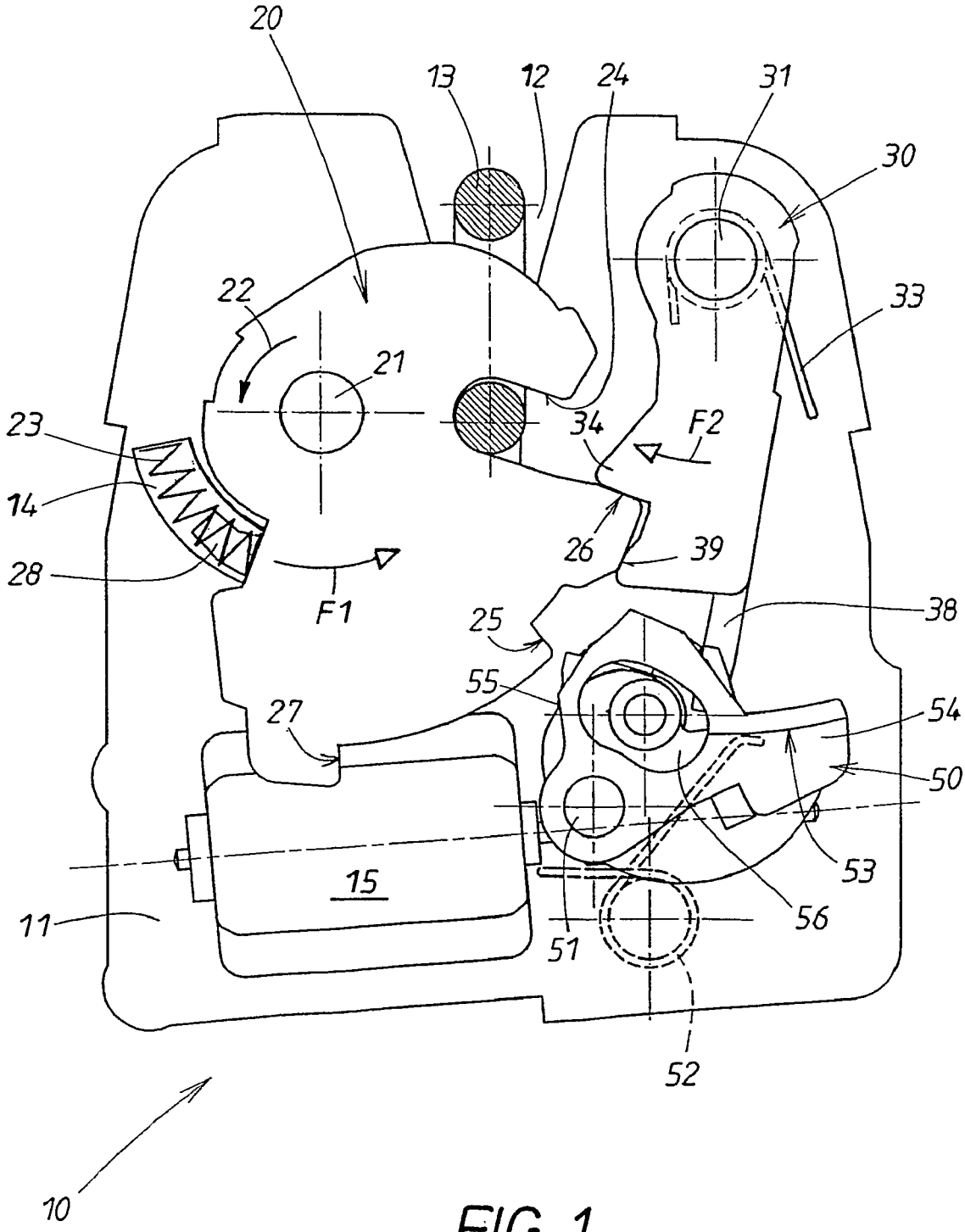
FIG. 1 shows a schematic diagram of the inventive lock with the rotary latch in its main latching position, the load lever also being shown.

The design of the lock is explained in greater detail below on the basis of the figures. The door lock includes a rotary latch 20, upon which the restoring force F1 of a spring 23 acts. This spring 23 is mounted on a mandrel 28 of the rotary latch 20 and moves inside a receiving channel 14 in the housing 11. The rotary latch 20 shown is supported on a journal bearing 21 in the housing 11 so that it can pivot freely and is usually fastened to the door (not shown). It could also be attached to a hatch, such as the rear hatch of a motor vehicle, instead of to a door. The rotary latch 20 has a slot-like receptacle 24 for a closing part 13, designed here in the form of a yoke. When the closing part 13 is disengaged from the rotary latch 20, as shown by way of example in FIG. 6, the latch is held in its open position by its spring-loading F1. The receptacle 24 of the rotary latch 20 remains accessible from the outside. The closing part 13 is usually fastened to the post of the door. The closing part 13, however, can also be mounted on the door, in which case the rotary latch 20 with its housing 11 would then be mounted permanently on the post.

Figure 6:
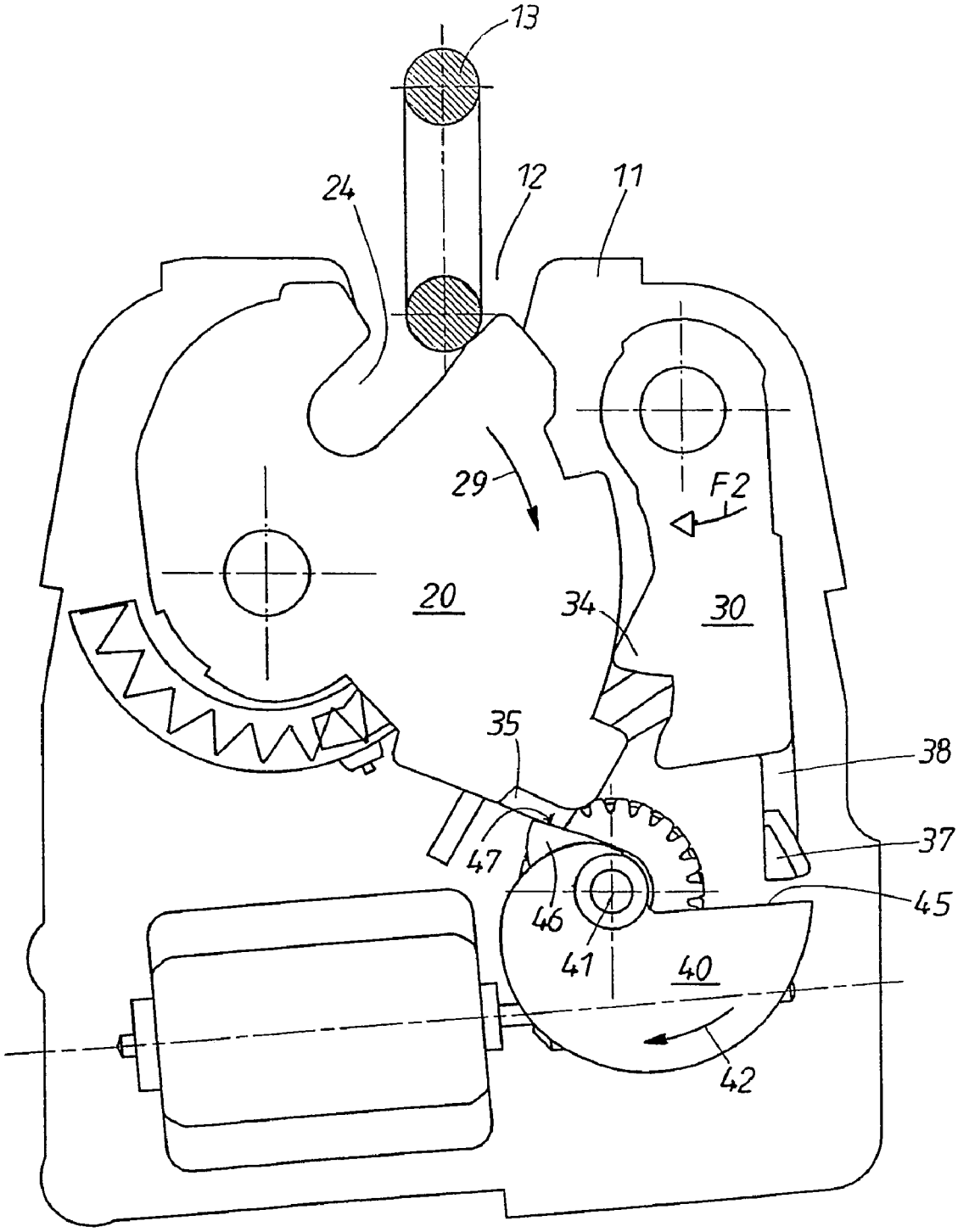
FIG. 6 shows a schematic diagram of the lock in the open position with the actuator in an end position.
Figure 7:
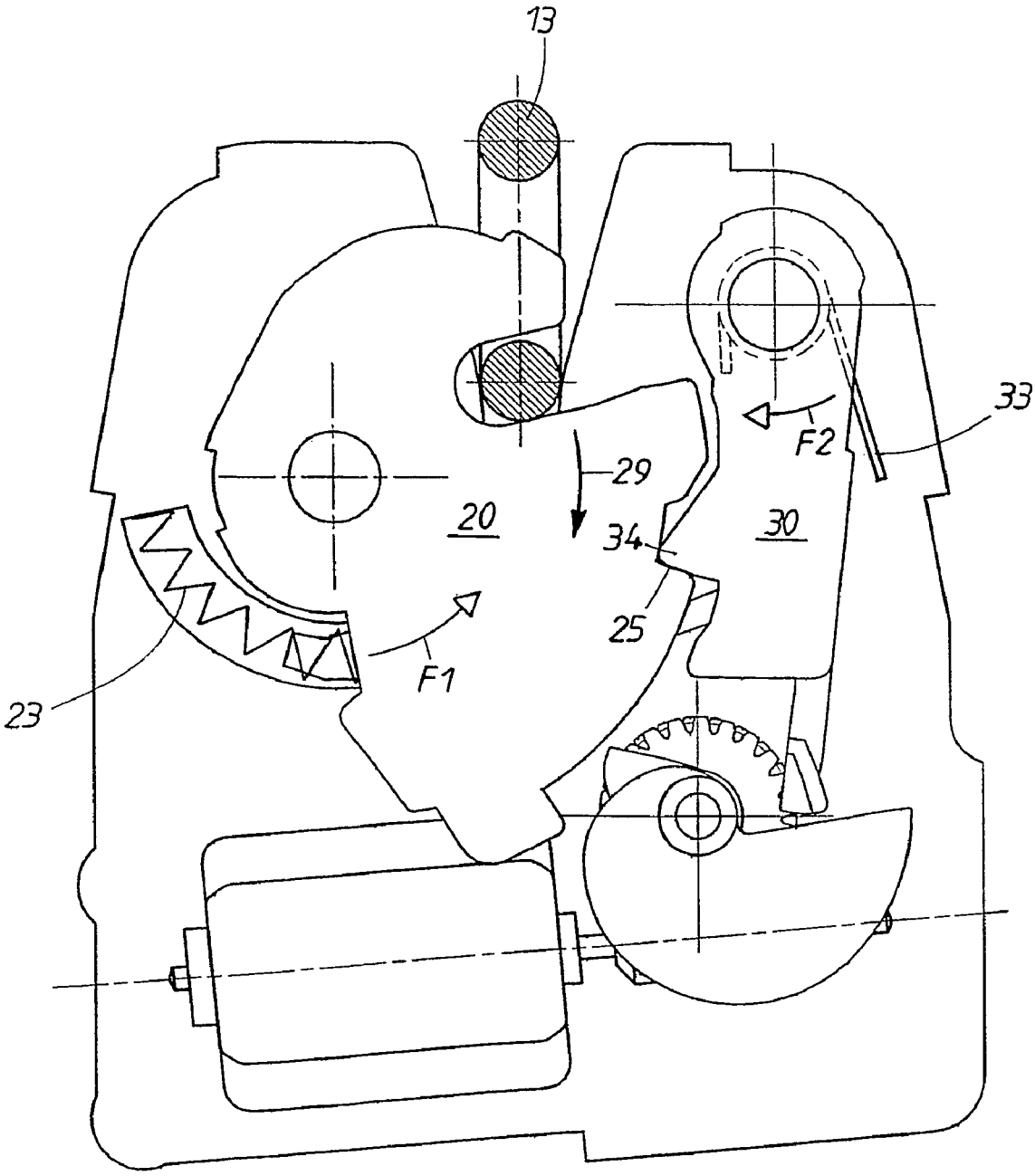
FIG. 7 shows a schematic diagram of the lock with a rotary catch in the prelatching position.

Proceeding from the release position of the rotary latch 20 shown in FIG. 6, the closing part moves into the receptacle 24 when the door is closed and thus pivots the rotary latch 20 in the direction of arrow 29 and thus in opposition to the restoring force F1 from the open position shown in FIG. 6 into the prelatching position shown in FIG. 7. The rotary latch 20 has at least two stop notches 25, 26, namely, a pre-stop notch 25 and a main stop notch 26. The hook 34 of a catch 30 engages either in the pre-stop notch 25 when the rotary latch 20 is in its previously mentioned prelatching position of FIG. 7 or in the main stop notch 26 when the rotary latch in the final, main latching position shown in FIG. 1.

Once the prelatching position of FIG. 7 is reached, there will usually be a gap between the door and the door post. As a rule, a motorized closing aid is provided, which acts on the rotary latch 20, moving the rotary latch into the main latching position in opposition to the restoring force F1; when this position is reached, the hook 34 of the catch 30 drops into the main stop notch 26 of the rotary latch 20. For its own part, the catch 30 is able to assume this main latching position, shown in FIG. 1, under the effect of the spring loading F2. For this purpose, the catch 30 is provided with a spring 33, which tensions the catch 30 around the pivot axis 31 in the direction toward the rotary latch 20.

Figure 2:
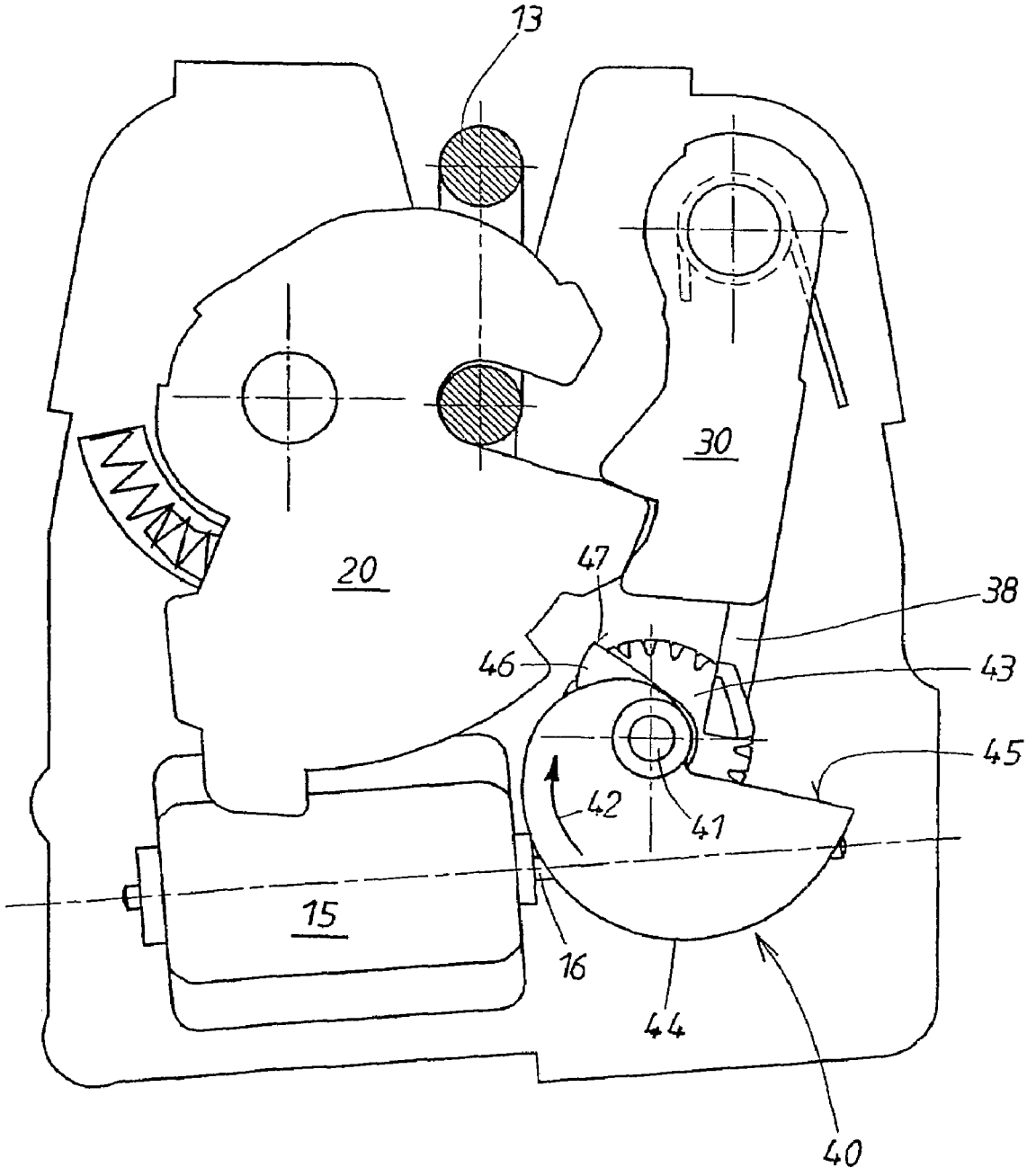
FIG. 2, shows a schematic diagram of the lock with the rotary latch in the main latching position but without the load lever.

FIG. 1 also shows a load lever 50, which can pivot around an axis 51 and which is held in the rest position shown in FIG. 1 by a spring 52, supported against a stop 53 on the load lever 50. This load lever 50 also has a recess 56, in which a journal bearing 41 fits, which provides the axis of rotation for an actuating element 40, shown more clearly in FIG. 2. FIG. 2 also shows the rotary latch 20 and the catch 30 in the main latching position. In this case, the load lever 50 has been omitted so that the actuating element 40 can be seen more clearly. This actuating element 40 has an actuating surface 44, the radial dimension of which increases in the rotational direction 42; it also has a blocking surface section 45, which, as will be described later, is gripped by a blocking element 37 of the catch 30 after the catch 30 has been raised. In FIG. 2, this actuating element 40 still has no contact with the catch 30.

Once the closing part 13 releases the rotary latch 20, the rotary latch 20 tries, under the effect of its restoring force F1, to move in the opening direction 22. The rotary latch 20, however, as FIGS. 1 and 2 show, is prevented from doing this by the catch 30. After the closing part 13 releases the rotary latch 20, a drive start signal can be sent to the drive unit 15. This drive unit 15 then starts to rotate the actuating element 40 in the direction 42. The drive energy from the drive unit 15 is transmitted by a pinion 16, for example, to a gear wheel 43, which is in working connection with the actuating element 40. In the exemplary embodiment shown here, the gear wheel 43 and the actuating element 40 rotate around the same axis of rotation 41. The gear wheel 43 and the actuating element 40 are not only connected to each other for rotation in common but are also in this case made as a single component.

Figure 3:
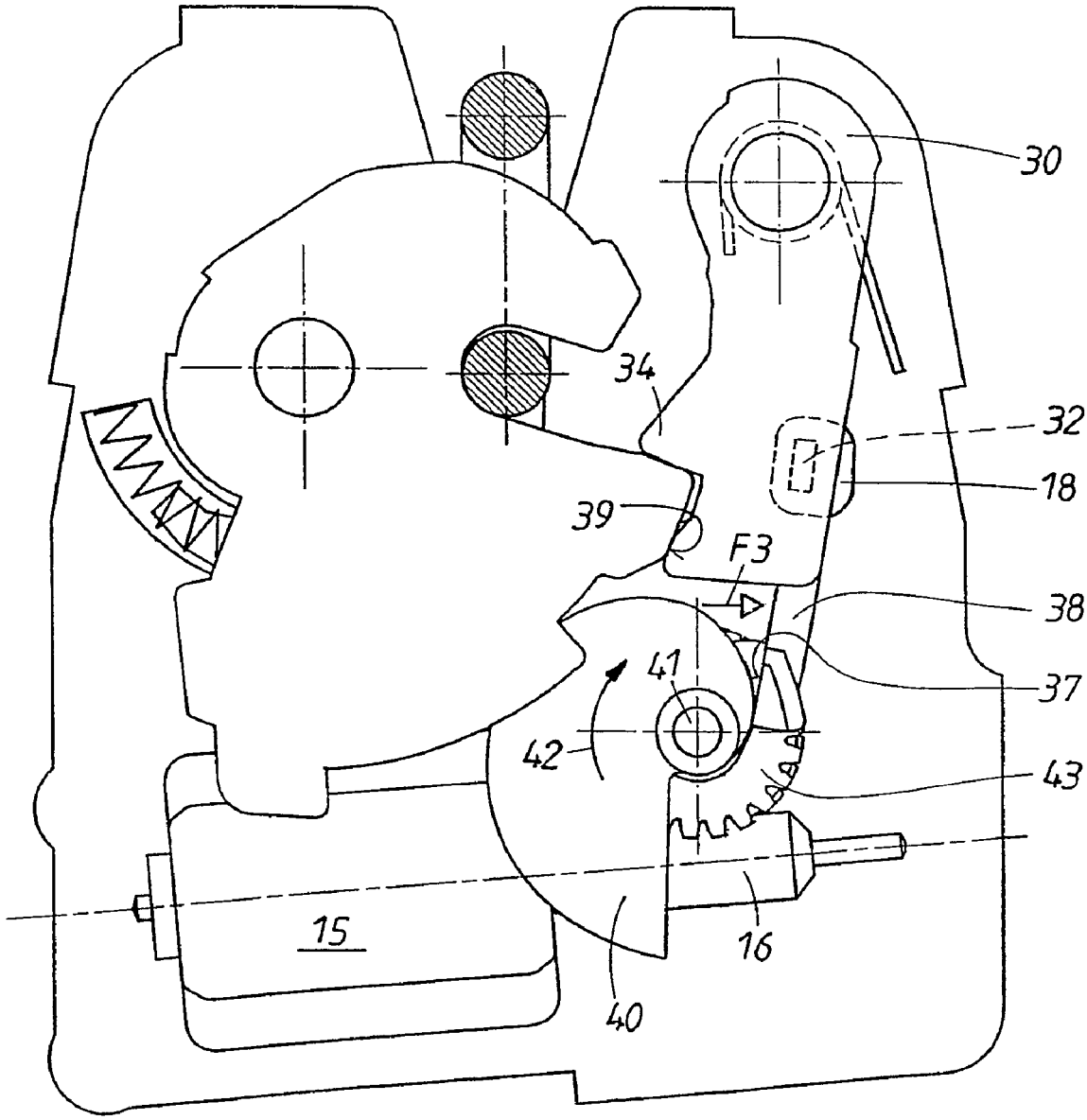
FIG. 3 shows a schematic diagram of the lock after the rotary latch has been released.
Figure 4:
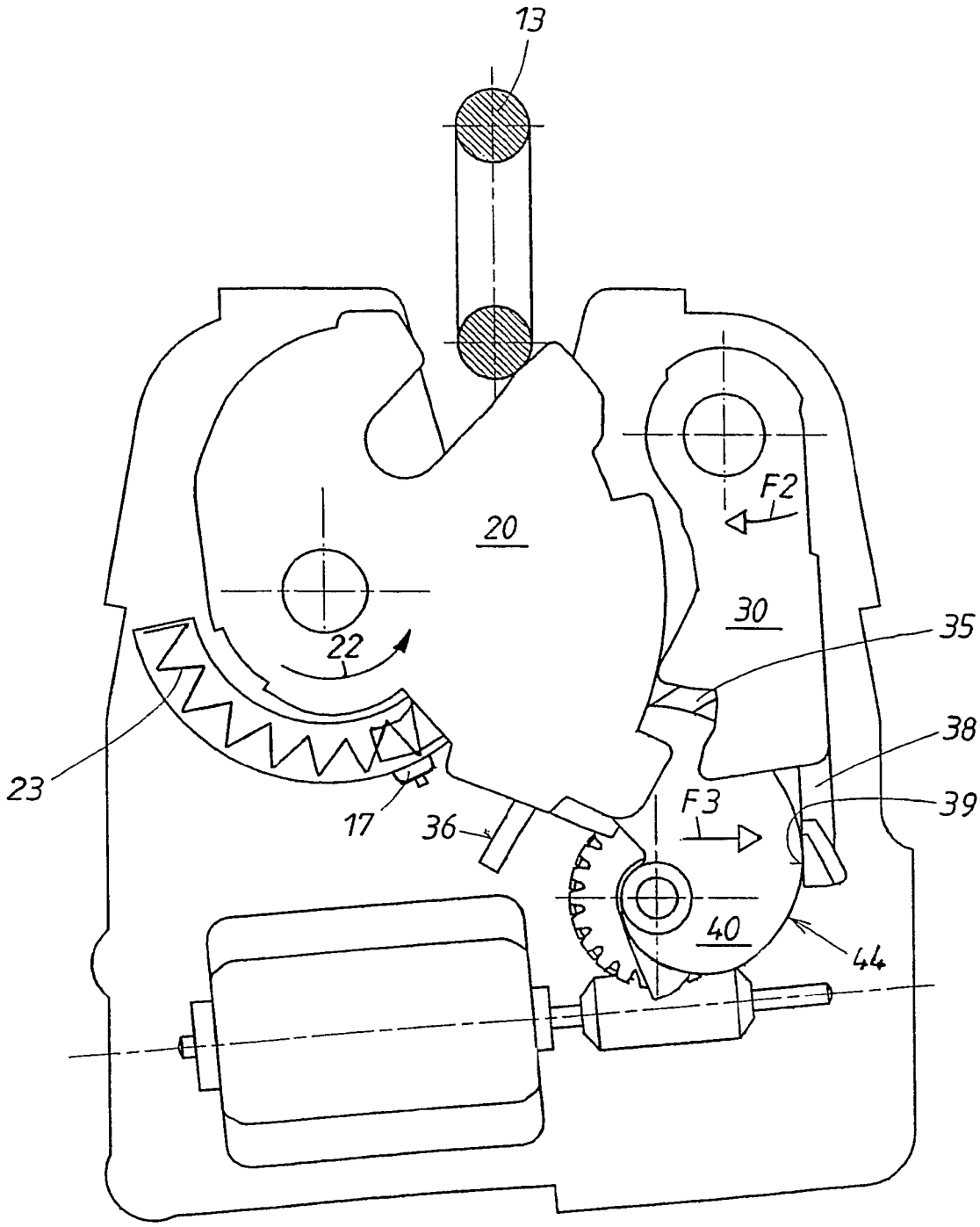
FIG. 4 shows a schematic diagram of the lock in the open position.
Figure 5:
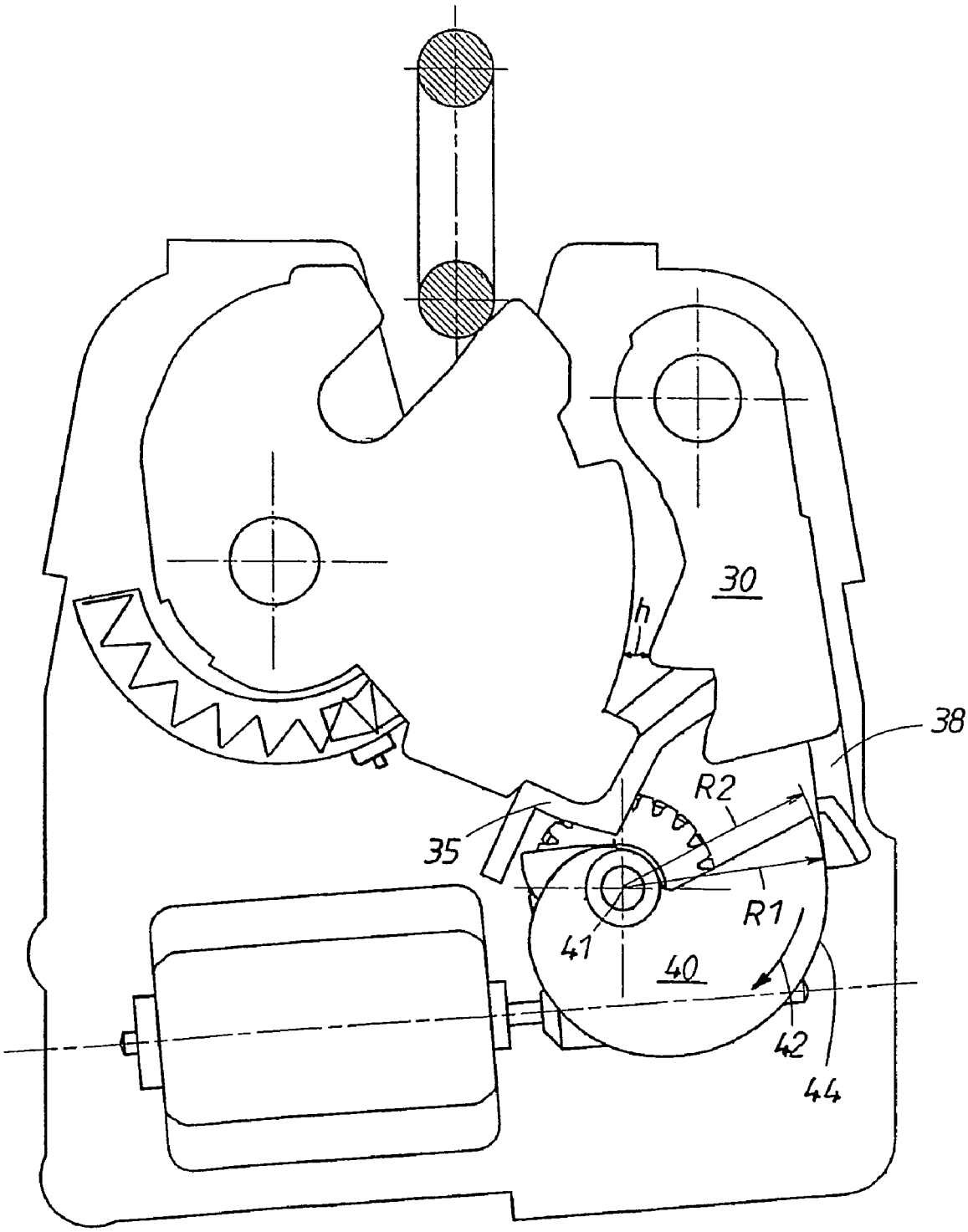
FIG. 5 shows a schematic diagram of the lock in the open position with the catch in an overstroke position.

When the actuating element 40, now functioning as an opening aid, moves in rotational direction 42, the actuating element 40 arrives, after rotation around a certain angle, in contact with the catch 30 (FIG. 3). The actuating surface 44 runs up against an actuating arm 38 of the catch 30. As the actuating element 40 continues to rotate in rotational direction 42, the catch 30 is raised against its restoring force F2 out of the main latching position or prelatching position on the rotary latch 20. This released position of the catch 30 is shown in FIG. 4. After this release of the catch 30, the actuating element 40 continues to rotate in rotational direction 42, and the catch 30 is pushed to a distance "h" away from the circumference of the rotary latch 20 by the actuating surface 44, the radial dimension of which continues to increase. This overstroke position of the catch 30 is shown in FIG. 5. At the radius R1, the actuating surface 44 of the actuating element 40 is at its maximum distance from the axis of rotation 41, and the catch 30 is located at its maximum distance "h" from the rotary latch 20. As shown in the example, it is possible for the actuating element 40 to move even further in the rotational direction 42, in which case the radius of the actuating surface 44 no longer changes. This means that the catch 30 remains in the same overstroke position. The section of the actuating surface 44 which does not change between radius R1 and radius R2 is also referred to as the "plateau surface" and allows the catch to remain in the overstroke position for a certain length of time without the need to use complicated connecting or control means for this purpose.

FIG. 3 shows that the catch 30 can also be equipped with a release shank 32, which passes through an opening 18 in the housing 11. This release shank makes it possible for the catch 30 to be moved out of the latching positions on the rotary latch 20.

It can also be derived from FIGS. 4 and 5 that the catch 30 has another arm 35 with a thrust surface 36 at the end. This thrust surface 36 actuates a signal switch 17 when the catch 30 is in the main latching position. As soon as the catch 30 with its hook 34 moves out of the main latching or prelatching position into the released position, this signal switch 17 is released, and the signal switch 17 can now send a signal which indicates that the catch 30 has been released.

FIG. 6 shows the end position of the actuating element 40 in rotational direction 42. In this end position, the actuating element 40 has released the actuating arm 38 of the catch 30, so that the catch 30 now pivots in the direction back toward the rotary latch 20 under the action of its spring loading F2. It is possible that the actuating element 40 might try to move in the direction opposite the rotational direction 42, not as a result of the drive element 15 but rather as a result of a load on the actuating element 40. This reverse rotation is prevented by a blocking element 37, provided on the end of the actuating arm 38 of the catch 30. This blocking element will meet the blocking surface section 45 of the actuating element 40 and thus prevent the actuating element 40 from turning in the reverse direction. This blocking can also be supported by a cam disk 46 mounted on the actuating element 40, which in this example moves around the same axis of rotation 41 and is mounted between the gear wheel 43 and the actuating surface 44. This cam disk 46 also has a blocking section 47, which, at the moment when the blocking element 37 of the catch 30 runs up against the blocking surface section 45 of the actuating surface 44, meets a corresponding section of the arm 35 of the catch 30, as is clear from FIG. 6.

After this end position of the actuating element 40 has been reached, a drive stop signal or a signal for restoring the gearbox to its starting position can be transmitted.

FIG. 6 shows the open position. During the process of closing the rotary latch 20, the closing part 13 moves down the slot 12 in the housing 11 until it makes contact with one side of the receptacle 24 in the rotary latch 20 and is thus is able to move the rotary latch 20 by the application of appropriate thrust in the closing direction 29. The rotary latch 20 arrives first in the prelatching position, in which the hook 34 of the catch 30 engages with the pre-stop notch 25 in the rotary latch 20. This is shown in FIG. 7. Upon further rotation in the closing direction 29 in opposition to the restoring force F1 of the rotary latch 20, the rotary latch 20 arrives in the main latching position, which is shown in FIGS. 1 and 2.

The function of the load lever 50 will now be explained on the basis of FIG. 1. In this main latching position of the rotary latch 20 with the catch 30, the load lever 50 is in a rest position. This load lever 50 is free to pivot around the axis 51 in opposition to the spring loading F4.

Figure 8:
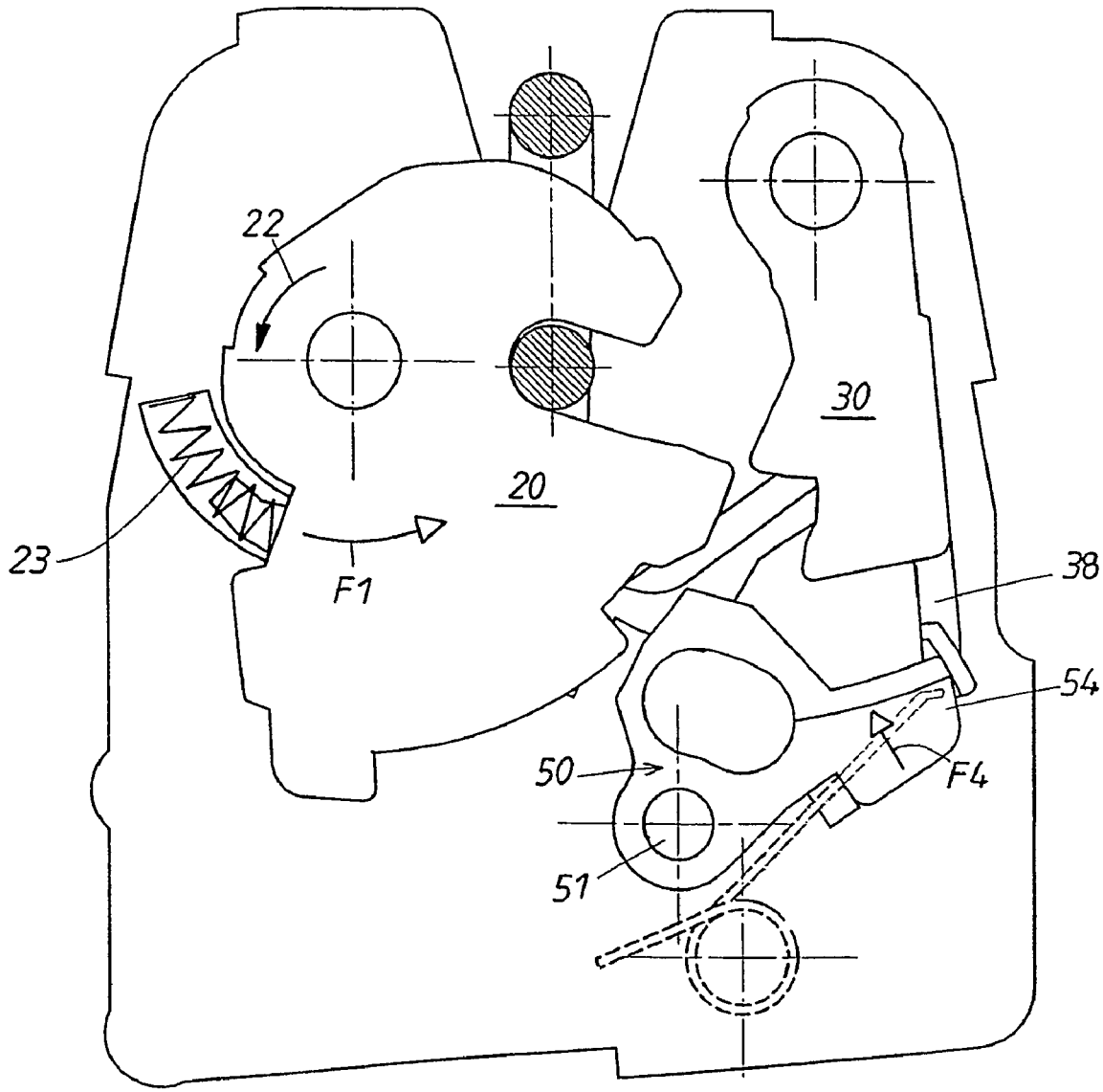
FIG. 8 shows a schematic diagram of the lock with a rotary latch which is blocked in the main latching position.
Figure 9:
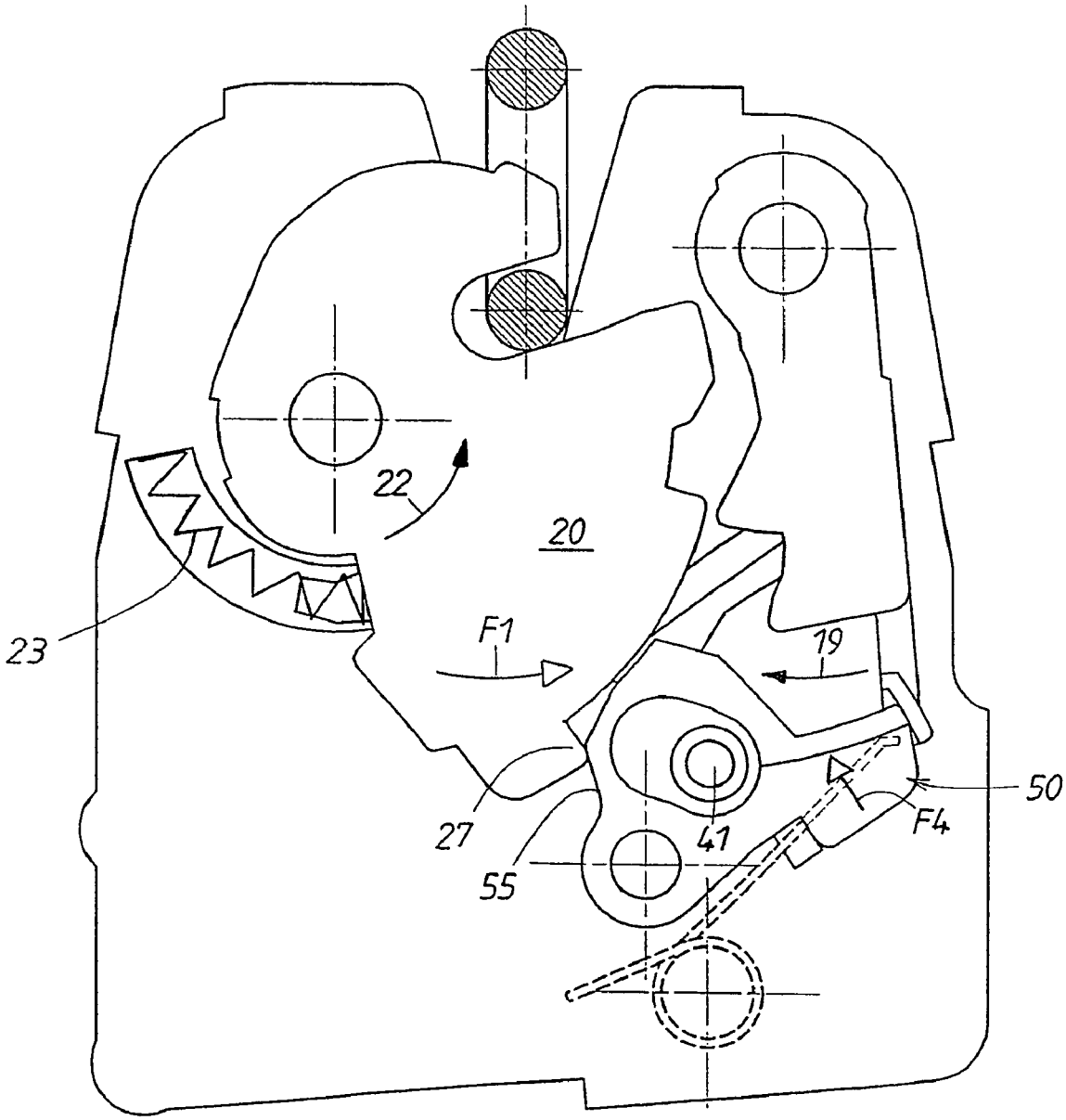
FIG. 9 shows a schematic diagram of the lock with a rotary latch in the process of opening.
Figure 10:
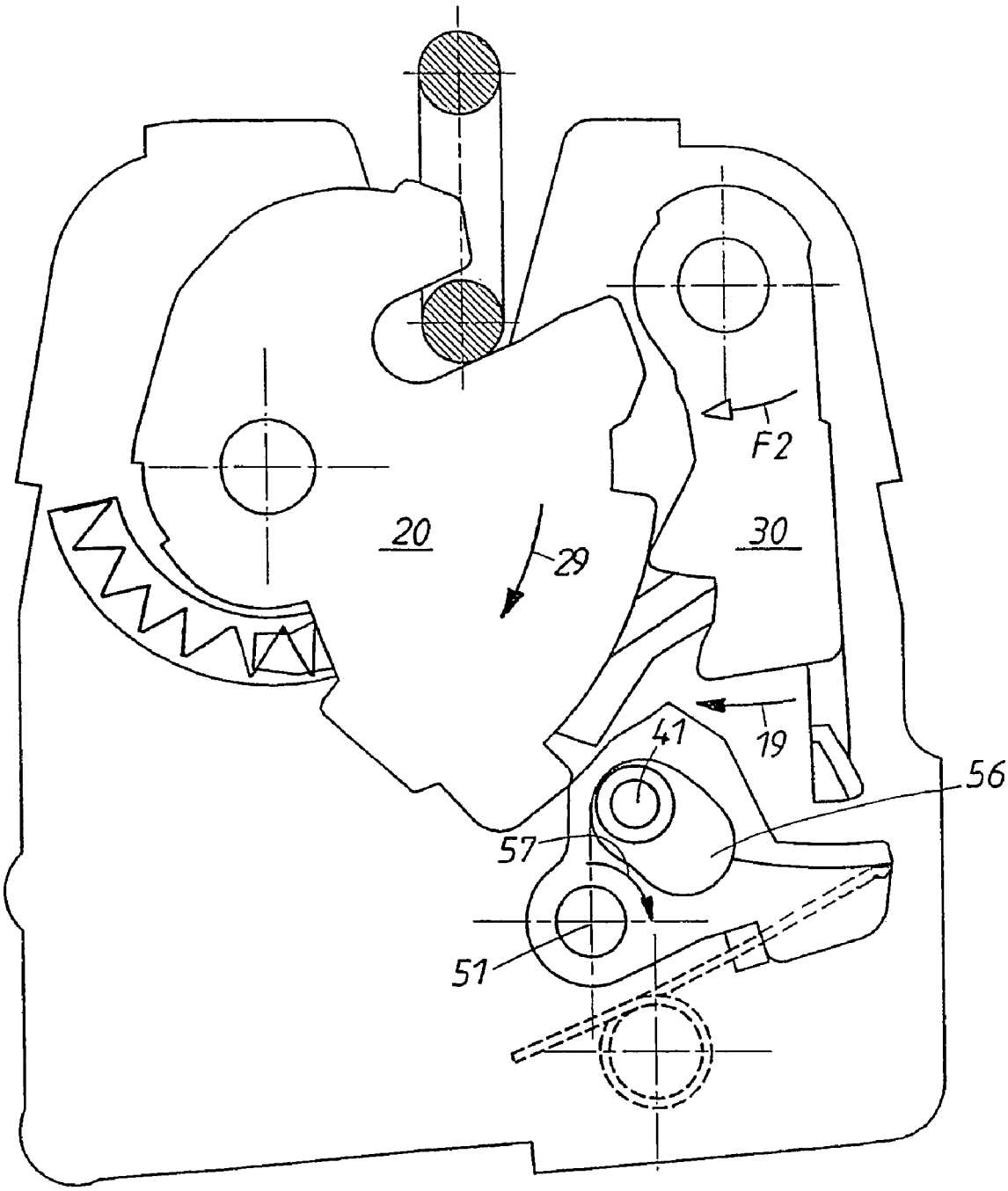
FIG. 10 shows a schematic diagram of the lock with a load lever in an overstroke position.

The load lever 50 serves as an opening aid by preventing the catch 30 from dropping back into the rotary latch 20 after the catch 30 has been raised by the actuating element 40. Even if, for example, the rotary latch 20 is blocked from moving in the opening direction 22 by snow or ice, a signal will still be sent to the drive element 15, as a result of which the actuating element 40 will move the catch 30 out of the main latching position or prelatching position. The rotary latch 20, however, will still remain in the main latching position or in the prelatching position. To prevent the catch 30 from dropping back into the rotary latch 20, which has not yet moved out of the main or prelatching position at the end of the rotational movement of the actuating element 40, a projection 54 of the load lever grips the outward-pivoted actuating arm 38 of the catch 30. Because of the spring loading F4, the load lever 50 can move into the pivot path 19 of the catch 30 and thus prevent the catch 30 from pivoting back into the rotary latch. This is shown in FIG. 8. The rotary latch 20 is blocked in the rotational direction 22 in which it opens. It is still in the main latching position. The catch 30 has already been pivoted outward by action of the actuating element 40 and is prevented by the load lever 50 from dropping back into the main stop notch of the rotary latch 20. When the blockade of the rotary latch 20 released, e.g., when the ice present in the lock 10 finally melts, the rotary latch 20 can continue to move automatically in the opening direction 22 as a result of the restoring force F1. During this rotational movement, the shoulder 27 of the rotary latch 20 comes into contact with the load lever 50, this shoulder 27 pressing against a circumferential section 55 of the load lever 50. This is shown in FIG. 9. Because the spring loading F1 of the rotary latch 20 is greater than the spring loading F4 of the load lever 50, the lever is pivoted around its axis of rotation 51 in opposition to the spring loading F4. By means of the pivoting moment exerted by the shoulder 27 of the rotary latch 20, the load lever 50 is moved into a position beyond its rest position on the catch 30, i.e., a position which is a certain distance away from the catch 30, in which position the catch 30 is now free to pivot along the path 19. As a result of its spring loading F2, the catch 30 can move toward the rotary latch, that is, toward its rest position. This is shown in FIG. 10. The pivot axis 51 of the load lever 50 is a certain distance away from the axis of rotation 41 of the actuating element 40. The pivot pin of the axis of rotation 41 of the actuating element 40 is located in the recess 56 of the load lever 50. This recess 56 has a shape which allows the load lever 50 to perform the pivoting movement 57. For this purpose, the recess 56 preferably has a longitudinal dimension aligned with the pivoting movement 57, so that the pivot pin, which represents the axis of rotation 41 of the actuating element 40, is preferably located at one end or in the center of the recess 56 when the load lever 50 is in the rest position, and comes to rest against the other end of the recess 56 when the load lever 50 is fully deflected.

As can be seen in FIG. 10, when the load lever 50 is releasing the catch 30, it rotates in the direction opposite the direction 22 in which the rotary latch 20 rotates when it opens.

Figure 11:
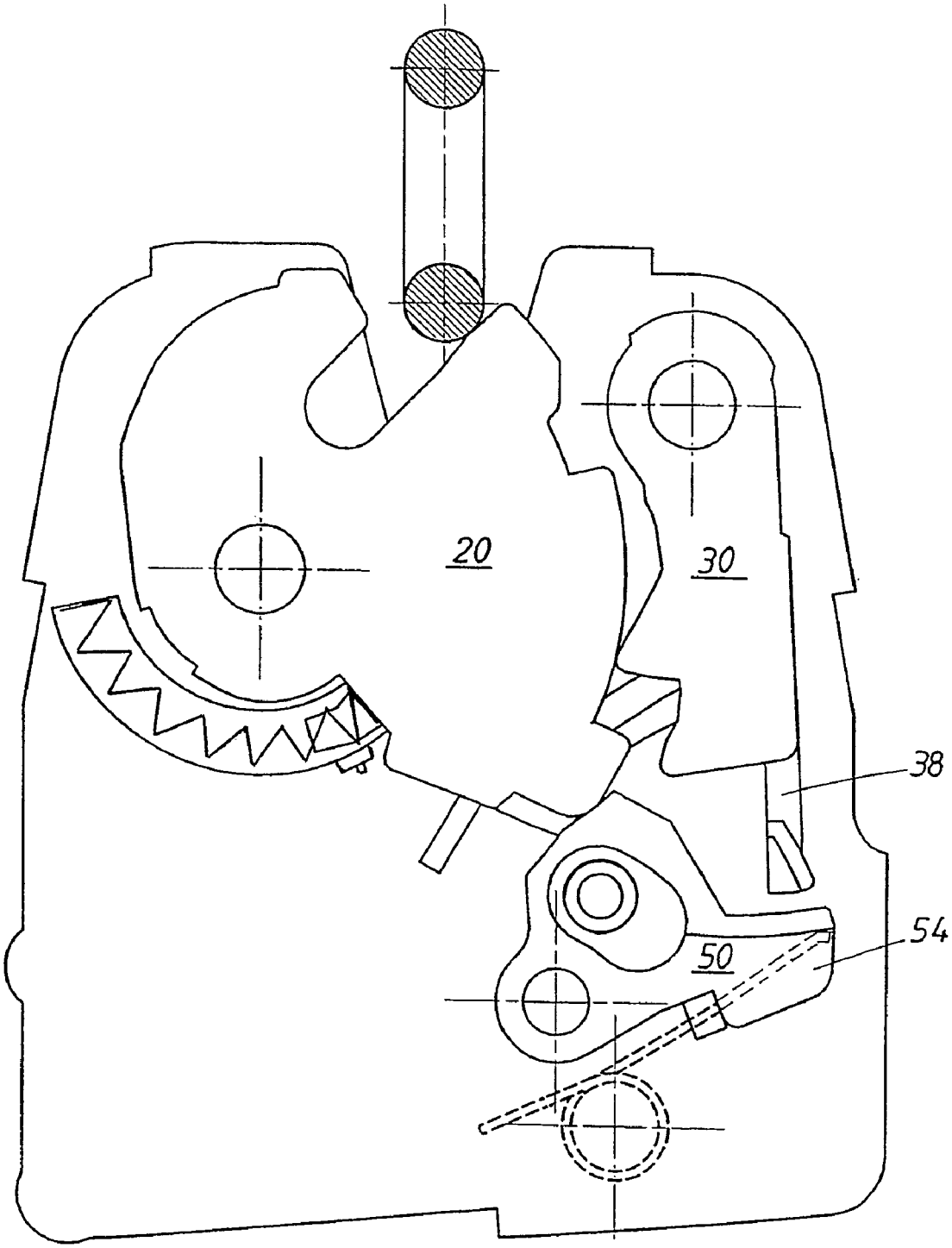
FIG. 11 shows a schematic diagram of the lock with a rotary latch in the open position.

FIG. 11 shows the open position of the door. The closing element 13 is located outside the rotary latch 20. The rotary latch 20 is in the rest position, and the load lever 50 is held in its out-of-the-way position by the rotary latch 20. The load lever 50 does not pivot back into its rest position until, during the closing process, i.e., the movement of the rotary latch in the closing direction 29, the shoulder 27 of the rotary latch 20 breaks contact with the load lever 50 and thus makes it possible for the load lever 50 to pivot back into its rest position.

LIST OF REFERENCE NUMBERS

10 lock
11 housing
12 slot
13 closing part
14 receiving channel for 23
15 drive unit
16 pinion
17 signal switch
18 opening for 32
19 pivoting path of 30
20 rotary latch
21 journal bearing of 20, axis of rotation
22 rotation in the opening direction
23 spring
24 receptacle for 13
25 prelatching stop notch
26 main stop notch
27 shoulder
28 mandrel
29 rotation in the closing direction
30 catch
31 journal bearing of 30, pivot axis
32 release shank
33 spring
34 hook
35 arm
36 thrust surface
37 blocking element
38 actuating arm
39 contact surface
40 actuating element
41 journal bearing of 40, axis of rotation
42 rotational direction
43 gear wheel
44 actuating surface
45 blocking surface section
46 cam disk
47 blocking section

50 load lever
51 journal bearing of 50, pivot axis
52 spring
53 stop
54 projection
55 circumferential section
56 recess
57 pivoting moment
F1 spring loading on 20
F2 spring loading on 30
F3 thrusting force of 40
F4 spring loading on 50
h overstroke
R1 radius
R2 radius

The invention claimed is:

1. Lock, especially for vehicle doors, hatches, or the like, with a rotary latch (20), into which a closing part (13) travels when the door is closed, thus pivoting the rotary latch (20) from an open position via a prelatching position into a main latching position;

with a catch (30), which, when in the prelatching position, engages in a prelatching stop notch (25) provided on the rotary latch (20) and, when in the main latching position, engages in a main stop notch (26) located on the rotary latch (20); and with a motorized opening aid for the door, comprising a drive unit (15), which uses a power takeoff path to rotate the actuating element (40), which acts directly on the catch (30);

where the actuating element (40) has an actuating surface (44), the radial dimension of which increases in the rotational direction (42);

and where the actuating element (40) has, on its actuating surface (44), a blocking surface section (45), which serves to prevent the actuating element (40) from rotating in the opposite direction, which blocking surface section is gripped by a blocking element (37) of the catch (30) after the catch (30) has been lifted; and with means for preventing the catch (30) from dropping back into the rotary latch (20) after the catch (30) has been lifted, wherein a load lever (50), which can be pivoted around the pivot axis (51) and moved into the path (19) along which the catch (30) pivots, prevents the catch (30) from dropping back into the rotary latch (20) after the catch (30) has been lifted; and in that a pivoting moment in the pivoting direction (57) is exerted directly on the load lever (50) by the rotary latch (20) as the latch rotates in the opening direction (22), as a result of which the load lever (50) is pivoted into a position beyond its rest position on the catch (30), i.e., a position a certain distance away from the catch (30), in which position the catch (30) is free to pivot along its path (19).

2. Lock according to claim 1, wherein, after the rotary latch (20) has been released by the closing part (13), a drive start signal for the drive unit (15) can be transmitted, where the drive part (15) causes the actuating element (40) to move in rotational direction (42).

3. Lock according to claim 1, wherein the drive energy of the drive unit (15) can be transmitted via a pinion (16) to a gear wheel (43), the gear wheel (43) being in working connection with the actuating element (40).

4. Lock according to claim 1, wherein the gear wheel (43) and the actuating element (40) have the same axis of rotation (41), and in that the gear wheel (43) and the actuating element (40) are connected to each other for rotation in common, preferably constituting a single component.

5. Lock according to claim 1, wherein the actuating element (40) functioning as an opening aid moves in rotational direction (42), and in that the rotary latch (20) moves in the opposite rotational direction (22) during the opening process.

6. Lock according to claim 1, wherein the actuating element (40) functioning as an opening aid runs up against an actuating arm (38) of the catch (30) and lifts the catch (30) out of the main latching position or out of the prelatching position on the rotary latch (20) in opposition to a restoring force (F2).

7. Lock according to claim 1, wherein, after the catch (30) has been lifted out of the main latching position or out of the prelatching position on the rotary latch (20), it is brought by the actuating element (40) into an overstroke position, as a result of which the hook (34) on the latch (30) is held a certain distance (h) away from the circumference of the rotary latch (20).

8. Lock according to claim 1, wherein the actuating surface (44) of the actuating element (40), the radial dimension of which increases in the rotational direction (42), is at its maximum distance from the axis of rotation (41) at radius (R1), as a result of which the catch (30) is in its overstroke position and thus at its maximum distance (h) from the rotary latch (20), and in that, upon the further movement of the actuating element (40) in rotational direction (42), the radius (R2) of the actuating surface (44) remains unchanged.

9. Lock according to claim 1, wherein the blocking element (37) is located at the end of the adjusting arm (38) of the catch (30), and in that, after the catch (30) has been raised, the blocking surface section (45) of the actuating element (40) comes to rest against this blocking element when the actuating element tries to rotate in the direction opposite the rotational direction (42).

10. Lock according to claim 1, wherein the blocking surface section (45) which has run up against the blocking element (37) triggers a drive stop signal and/or a signal for restoring the gearbox to the home position.

11. Lock according to claim 1, wherein the catch (39) has another arm (35) with a thrust surface (36) at the end, which actuates a signal switch (17) only when the catch (30) is located in the main stop notch (26) on the rotary latch (20).

12. Lock according to claim 1, wherein a spring loading (F2) causes the hook (34) of the catch (30) to drop into the main stop notch (26) or into the pre-stop notch (25) of the rotary latch.

13. Lock according to claim 1, wherein—after the catch (30) has been raised—the rotary latch (20) is guided automatically by the spring loading (F1) acting on it out of its prelatching position or out of its main latching position into its open position.

14. Lock according to claim 1, wherein, to prevent the catch (30) from dropping back into the rotary latch (20), a spring-loaded (F4) projection (54) of the load lever (50) blocks the outward-pivoted adjusting arm (38) of the catch (30) and thus prevents the catch (30) from pivoting along its path (19).

15. Lock according to claim 1, wherein the load lever (50) can be moved around a pivot axis (51).

16. Lock according to claim 1, wherein the pivot axis (51) of the load lever (50) is a certain distance away from the axis of rotation (41) of the actuating element (40), where the pivot pin of the actuating element (40) representing the axis of rotation (41) engages in a recess (56) in the load lever (50), where the recess (56) preferably has a longitudinal dimension aligned with the pivoting movement (57).

17. Lock according to claim 1, wherein the pivoting moment which moves the load lever (50) out of the rest position is produced by a shoulder (27) on the rotary latch (20), which in this case pushes a circumferential section (55) of the load lever (50) in the pivoting direction (57).

18. Lock according to claim 1, wherein, when the load lever (50) is releasing the catch (30), it is moving in the pivoting direction (57), whereas the rotary latch (20) is moving in the opposite rotational direction (22).

* * * * *

UNITED STATES PATENT AND TRADEMARK OFFICE

CERTIFICATE OF CORRECTION

PATENT NO. : 7,175,210 B2
APPLICATION NO. : 10/505202
DATED : February 13, 2007
INVENTOR(S) : Udo Orzech, Stefan Uecker and Eckart Schuler It is certified that error appears in the above-identified patent and that said Letters Patent is hereby corrected as shown below:

On the title page, item [73] should read:
[73] Assignees: Huf Hülsbeck & Fürst GmbH & Co. KG, Velbert (DE);
DaimlerChrysler AG, Stuttgart (DE)

Signed and Sealed this

Second Day of March, 2010

David J. Kappos

David J. Kappos
*Director of the United States Patent and Trademark Office*